US009397443B2

(12) United States Patent
Pade

(10) Patent No.: US 9,397,443 B2
(45) Date of Patent: Jul. 19, 2016

(54) ELECTRIC PLUG-IN SYSTEM

(71) Applicant: Robert Bosch GmbH, Stuttgart (DE)

(72) Inventor: Wolfgang Pade, Illingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/421,765

(22) PCT Filed: Aug. 7, 2013

(86) PCT No.: PCT/EP2013/066587
§ 371 (c)(1),
(2) Date: Feb. 13, 2015

(87) PCT Pub. No.: WO2014/026899
PCT Pub. Date: Feb. 20, 2014

(65) Prior Publication Data

US 2015/0200487 A1 Jul. 16, 2015

(30) Foreign Application Priority Data

Aug. 14, 2012 (DE) ..... 10 2012 214 433
Jul. 2, 2013 (DE) ..... 10 2013 212 914

(51) Int. Cl.
*H01R 13/62* (2006.01)
*H01R 13/629* (2006.01)
(Continued)

(52) U.S. Cl.
CPC ..... *H01R 13/62944* (2013.01); *H01R 13/5208* (2013.01); *H01R 13/5219* (2013.01); *H01R 13/5841* (2013.01); *H01R 13/62955* (2013.01)

(58) Field of Classification Search
CPC ..... H01R 13/62944; H01R 13/62955; H01R 13/62966; H01R 13/5208; H01R 13/5219; H01R 13/5841; H01R 13/62988; H01R 13/62933
USPC ..... 439/157, 152, 153, 261, 288, 341, 836, 439/837
See application file for complete search history.

(56) References Cited

U.S. PATENT DOCUMENTS 6,217,354 B1 * 4/2001 Fencl ..... H01R 13/62977 439/157
6,312,272 B1 * 11/2001 Gaupp ..... H01R 13/62944 439/157

(Continued)

FOREIGN PATENT DOCUMENTS

DE 29513172 10/1995
DE 102009035729 3/2010

(Continued)

OTHER PUBLICATIONS

International Search Report for PCT/EP2013/066587, issued on Oct. 9, 2013.

*Primary Examiner* — Abdullah Riyami
*Assistant Examiner* — Harshad Patel
(74) *Attorney, Agent, or Firm* — Norton Rose Fulbright US LLP

(57) ABSTRACT

A plug-in system is provided for a control unit of a vehicle, including a plug, such as a cable harness, and a plug module. The plug is designed to produce an electrical connection with the plug module. The plug has a plug body that accommodates a multiplicity of electrical contacts and that has a plug base that is designed to accommodate a shroud of the plug module. In addition, the plug has a plug lever that is designed to be moved from a start position to an end position, while pulling the plug in the direction of the plug module using a lever arm that engages in the plug module. The plug lever can be mounted on the plug body in two orientations, and in both the orientations the lever arm and the plug module engage in one another in such a way that the plug can be pulled in the direction of the plug module.

10 Claims, 8 Drawing Sheets

(51) Int. Cl.
*H01R 13/52* (2006.01)
*H01R 13/58* (2006.01)

(56) References Cited

U.S. PATENT DOCUMENTS 6,488,516 B2 * 12/2002 Osawa ..... H01R 13/62933 439/157
6,540,532 B1 4/2003 Martin et al.
6,558,176 B1 * 5/2003 Martin ..... H01R 13/62944 439/157
2006/0110960 A1 5/2006 Yamaoka

FOREIGN PATENT DOCUMENTS

EP 1306931 5/2003
EP 1355385 10/2003
JP 11185872 A 7/1999
JP 2006147492 A 6/2006
JP 2008530763 A 8/2008

* cited by examiner

ELECTRIC PLUG-IN SYSTEM

FIELD OF THE INVENTION

The present invention relates to an electrical plug-in system having a plug and a plug module.

BACKGROUND INFORMATION

In a vehicle, in the engine compartment and in the body compartment there are numerous electrical and electronic control devices that have to be electrically connected to one another and to further components of the vehicle such as sensors and actuators.

For this purpose, on a control device there can be a plug module whose multipoint connector can have several hundred poles. A corresponding plug, connected to a cable harness, can be plugged onto the plug module to create the electrical connection. For this purpose, the plug can have a lever that engages in a toothed rod on the plug module and that pulls the plug in the direction of the plug module when there is a closing movement.

For such a plug having a plug lever, the plug connection between the cable harness plug and the multipoint connector is designed to be non-sealing, because the toothed rod situated in the interior on a shroud of the plug module, and the shaft on the lever that engages in the toothed rod, prevent a seal from being situated between the shroud and the plug.

Due to the lack of a seal, the electrical contacts of the plug module and of the plug are exposed to the media—in part aggressive—in the engine compartment or in the body compartment.

In addition, as a rule the plug lever can be mounted on the plug in only one orientation. Also, as a rule the plug connector can be closed or locked only at one side.

SUMMARY

An object of the present invention is to provide a plug-in system for a cable harness of a vehicle that can be assembled flexibly.

An aspect of the present invention relates to a plug-in system having a plug and having a plug module, the plug being designed to produce an electrical connection to the plug module. The plug module can for example be attached to a control unit of a vehicle, such as an engine control unit, and the plug can be connected to a cable harness of the vehicle. The plug and plug module can have more than 100 individual electrical contacts, for example produced via miniaturized electrical contacts that for example have a cross-section of 0.5 mm by 0.4 mm, and that are configured with a contact spacing of 1.8 mm. Such plug-in systems can be used for example in a vehicle (passenger vehicle, truck, bus). The plug module can for example be attached to a control device. The plug can be used to connect the control device, for example an engine control device, to a cable harness.

Specific embodiments of the present invention advantageously make it possible to provide a variable plug-in system for a control unit of a vehicle in which the plug lever and a guide of the electrical lines in the plug, i.e. a cable conduit, can be mounted on the plug in a plurality of orientations.

According to a specific embodiment of the present invention, the plug of the plug-in system has a plug body that accommodates a plurality of electrical contacts and that has a plug base that is designed to accept a shroud of the plug module. In addition, the plug has a plug lever that is designed to be moved from a start position to an end position while pulling the plug in the direction of the plug module through the action of a lever arm that engages in the plug module. In this way, the plug with the plug base can be positioned on the shroud, and can be connected to the plug module in a controlled fashion through a lever movement using the lever. Through the movement of the plug lever, on which for example there is situated a shaft having teeth that engage in corresponding projections on the shroud, a translational movement can be produced in which for example more than 100 electrical contacts are pushed into one another without unintentionally being damaged (bent). In addition, with the plug lever a very large mechanical translation ratio can be achieved, so that the multiplicity of electrical contacts can be pushed into one another without difficulty.

In addition, the plug has at least one sealing element that is designed to seal the plug plugged into the plug module against a surrounding environment of the plug. In particular, the plug lever is designed so that the interior of the plug can be sealed by sealing elements such as a radial seal and/or a mat seal. For example, the plug lever can engage externally on the shroud of the plug module, while the sealing element is pressed onto an inner side of the shroud.

For example, the plug can be designed such that the plug lever can be mounted on the plug body in two orientations, and the lever arm and the plug module can, in both orientations, engage in one another in such a way that the plug can be pulled in the direction of the plug module. Through the design according to the present invention of the plug-in system, in this way it can be enabled that the plug lever can be attached to the plug in two positions, for example rotated by 180° to one another, and in both positions the plug can be securely connected to the plug module using the plug lever.

Overall, the plug-in system can be designed to provide a plug connection that is flexible and variable with regard to a positioning of the plug, and at the same time can provide a long-lived and stable electrical connection between electrical lines of a cable harness in a vehicle and a control device.

The number of sensors and actuators installed in vehicles, as well as corresponding control units that are capable of processing information from the sensors and controlling the actuators, is constantly increasing. In a vehicle, the space available for sensors, actuators, and control devices may however be very limited, so that these components of the vehicle are increasingly produced in a miniaturized design. This also holds for the associated plugs and plug modules with which electrical connections are produced between the components. Therefore, it can also be required to produce the plugs and plug modules in a flexible and variable construction, so that they can be attached to a control unit in various positions in the available constructive space in a vehicle.

According to a specific embodiment of the present invention, the plug lever grasps the plug body with two lever arms that are connected by a cross-beam. On the two lever arms, which can run parallel to one another and to which the cross-beam can run in orthogonal fashion as lever handle, at the ends of the arms there can be shafts that are accommodated in the plug base and about which the plug lever can be moved. The shafts can for example be accommodated and movable in corresponding openings in the plug base. The openings can be fashioned symmetrically in the plug base, and can be situated symmetrically on two opposite sides of the plug body in such a way that the plug lever can be mounted on the plug in two positions rotated relative to one another for example by 180°.

According to a specific embodiment of the present invention, a lever arm of the plug lever has a shaft about which the lever can be moved, and that is oriented in the direction of the plug body. The shaft can have teeth, such as a lever tooth and/or a contact tooth, designed to engage in the plug module. For example, the teeth can engage in a corresponding toothed rod on the plug module. The plug lever can be a toothed rod lever.

According to a specific embodiment of the present invention, the shaft has a contact tooth that is designed to be supported on a projection on the shroud in the start position.

According to a specific embodiment of the present invention, the shaft has a lever tooth that is designed to grasp the projection, the lever tooth pulling the plug into the plug module when the lever is moved from the start position to the end position.

According to a specific embodiment of the present invention, the shaft has only one lever tooth and only one contact tooth, configured orthogonal to a direction of longitudinal extension of the shaft, and standing out from the shaft. The direction of longitudinal extension of the shaft can be defined by the axis of rotation about which the shaft can be moved in the plug body. A design and geometry of the shaft, having only one lever tooth and one contact tooth, can in addition be produced relatively simply and at low cost.

According to a specific embodiment of the present invention, the lever tooth is made longer than the contact tooth, so that the lever tooth stands out further from the shaft than does the contact tooth. In this way, relatively large lever forces can be produced, which can be necessary to pull the plug and the plug module into one another. In addition, a relatively large lever tooth can be made robust, so that the plug forces that occur during the plugging together of the plug and the plug module can be overcome by the lever forces without damaging the lever tooth, for example breaking it off.

According to a specific embodiment of the present invention, the shroud of the plug module has a plug channel that is designed to accept the shaft, the plug channel of the shroud being fashioned symmetrically with respect to the orientations of the plug lever. In other words, the shaft can equally be accepted by the plug channel of the shroud in both of the orientations in which the plug lever can be mounted on the plug body, so that in both orientations a translational movement can be produced by moving the plug lever from the start position to the end position, during which movement the plug and the plug module are pushed into one another in order to produce an electrical connection. Here, the plug channel can be understood as the toothed rod and the shaft can be understood as the toothed rod lever.

The plug channel can be situated on an external side of the shroud. In addition, two plug channels can be fashioned on two oppositely situated external sides on the shroud, each accepting a shaft of a lever arm of the plug lever.

According to a specific embodiment of the present invention, along a direction of plugging into the plug channel the plug channel has a first segment that provides two symmetrical projections, a second segment that provides two symmetrical openings, and a third segment that provides two further symmetrical projections. The symmetrical design of the plug channel can ensure the functioning of the shaft and of the lever tooth in both orientations of the plug lever.

According to a specific embodiment of the present invention, the projections of the first and of the third segment of the plug channel extend equally far into the channel. This can make it possible to push the shaft a certain distance into the third segment of the plug channel without coming to lie against a projection of the channel, which in turn can ensure that the plug and the plug module can be pushed far enough into one another to create an electrical connection.

According to a specific embodiment of the present invention, in the start position of the plug lever the lever tooth of the shaft grasps a projection of the plug channel, the lever tooth being designed to be pushed into an opening when the plug lever is moved from the start position to the end position, at the same time pulling the plug and the plug module into one another. In this way, on the shroud of the plug module there need be situated only a single projection or counter-tooth with which the lever movement can be converted into a translational movement. With the use of a single projection, this projection can be made relatively large, so that large forces can also be transmitted.

According to a specific embodiment of the present invention, in the start position of the plug lever the contact tooth of the shaft is supported on a projection, the contact tooth being designed to release the projection when the plug lever is moved from the start position to the end position. The projection can be situated on the outside of the shroud of the plug module.

According to a specific embodiment of the present invention, the plug-in system further includes a plug cover that has a cable conduit for guiding electrical lines out from the plug body. Here, the plug cover can be fastened on the plug body in two orientations, so that in the two orientations the cable conduit can guide the electrical lines out from the plug body in different directions. The orientations of the plug cover, and thus the directions in which the electrical lines are guided out from the plug body, can for example be rotated by 180° relative to one another. The cable conduit that can be led out in different orientations can also be advantageous with regard to possibly limited constructive space in a vehicle. Thus, after equipping the plug with electrical lines, i.e. connecting the plug to a cable harness, performed for example by a cable manufacturer, the cable conduit can subsequently be modified or adapted to a constructive space. Flexibility with regard to the cable conduit can also save costs in production, because only one plug, or one plug-in system, has to be produced for both orientations of the cable conduit. In addition, in this way a changing operation for different orientations of the plug cover and of the cable conduit can be omitted.

In addition, the plug has at least one sealing element that is designed to seal the plug plugged into the plug module against the surrounding environment of the plug. In particular, the plug lever is designed so that the interior of the plug can be sealed by sealing elements such as a radial seal and/or a mat seal. For example, the plug lever can engage on the shroud of the plug module from the outside, while the sealing element is pressed against an internal side of the shroud.

According to a specific embodiment of the present invention, the plug base has a plug element that is designed to be pushed into the plug module. The plug base can for example have a ring element, or jacket element, that guides the shaft of the plug lever, in the interior of which there is attached a further annular plug element. The ring element and the plug element can accommodate the shroud of the plug module between them. The plug element can be surrounded by a radial seal (i.e. a sealing ring) that is designed to be accommodated between the plug element and the shroud. The radial seal can thus seal the shroud from inside.

According to a specific embodiment of the present invention, the plug has a mat seal that is situated between the plug base and a plug cover. The mat seal can have channels that accommodate lines to the electrical contacts. Together with the radial seal, the mat seal can terminate the space formed by the plug and plug module.

According to a specific embodiment of the present invention, the plug lever has, at one end of a lever arm, a securing pin that, in the start position, lies against a stop element on the plug base, so that a movement of the plug lever from the start position to the end position is prevented. This prevents the plug from being positioned on the plug module in an undesired position, so that for example the teeth on the lever are not in the oriented position, or the plug can be pushed partly onto the plug module without the aid of the plug lever.

The securing pin can be designed to be pressed away from the plug base by the pressure of a ramp on the plug module, so that the securing pin slides over the stop element and releases the plug lever. In this way, with the securing pin a pre-stop is integrated into the plug. The plug lever remains in the start position until the securing pin is released. The plug lever can be actuated only when the plug is placed onto the plug module and the ramp releases the securing pin.

According to a specific embodiment of the present invention, on the plug base a further stop element is provided against which the securing pin lies in the end position, so that a movement of the lever past the end position is prevented. In this way, the plug and the plug module can be prevented from being pulled too far toward one another.

According to a specific embodiment of the present invention, the plug includes a plug securing device, or plug position securing device, that includes a slide element in a cross-beam of the plug lever and an unlocking pin on a plug cover, the slide element being capable of being slid from an unlocked position into a locked position when the slide element is pressed against the unlocking pin. With the plug securing device, the plug can be locked only when the plug lever is securely in the end position. The plug securing device is integrated into a plug and checks whether the plug lever is really in the end position, in which all electrical connections between the plug and plug module have been produced, and in which all sealing elements seal. Subsequently, using the plug securing device the plug lever can be protected against opening. In order to open the plug lever, the plug securing device has to be unlocked.

DETAILED DESCRIPTION

Figure 1:
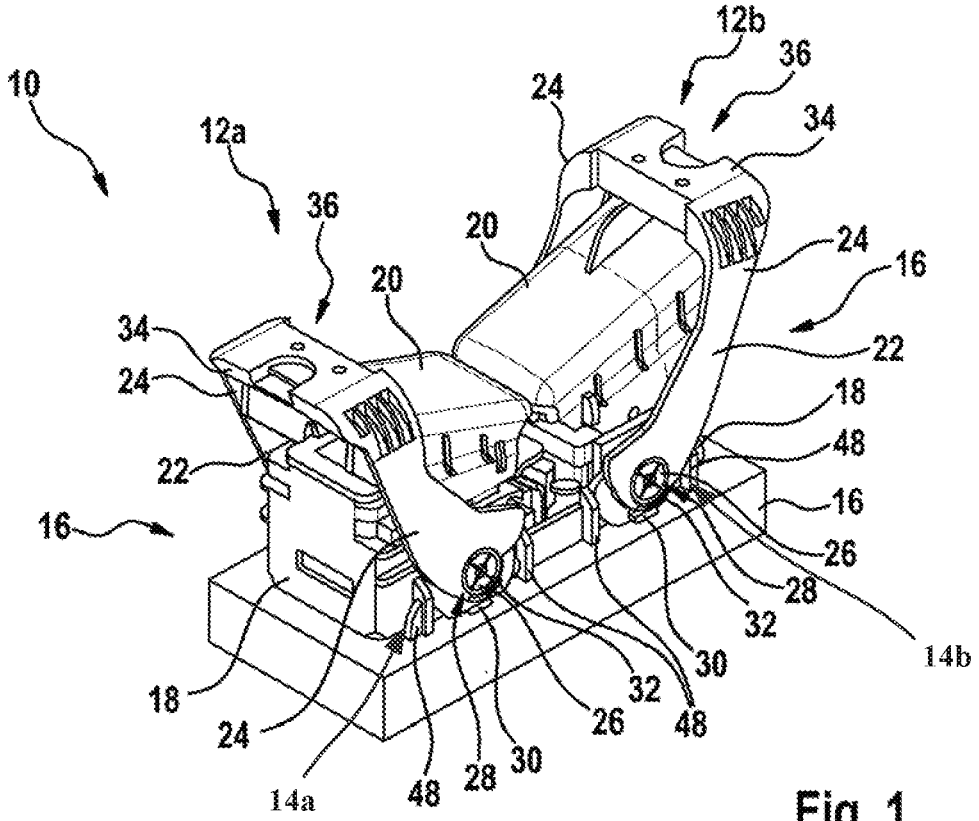
FIG. 1 shows a three-dimensional view of a plug-in system according to a specific embodiment of the present invention.

FIG. 1 shows a plug-in system 10 made up of two cable harness plugs 12*a*, 12*b* and two plug modules (or multipoint connectors) 14*a*, 14*b*. Both plugs 12*a*, 12*b* are in an end position, in which the interior of the plug-in system is sealed against external influences and in which all electrical contacts are connected.

Plugs 12*a*, 12*b* are symmetrical relative to a mid-plane of plug-in system 10, and plug-in system 10 is realized in such a way that plugs 12*a*, 12*b* can be plugged into plug modules 14*a*, 14*b* anti-symmetrically to one another.

The two plug modules 14*a*, 14*b* are housed in a common one-piece housing 16.

Each plug 12*a*, 12*b* has a plug body 16 having a plug base 18 and a plug cover 20 that closes plug base 18 on the side situated opposite the side of plug base 18 that is plugged onto plug module 14*a*, 14*b*.

A plug lever 22 of each plug 12*a*, 12*b* grasps plug body 16 in U-shaped fashion with two arms 24. A respective shaft 26 is situated on the ends of arms 24. The two shafts 26 of a plug lever 22 are accommodated in oppositely situated openings 28 in plug base 18.

Plug base 18 includes a guide groove 30 in which a rail 32 situated on shaft 26 is accommodated, which prevents a movement of associated lever arm 24 in the axial direction.

Figure 6:
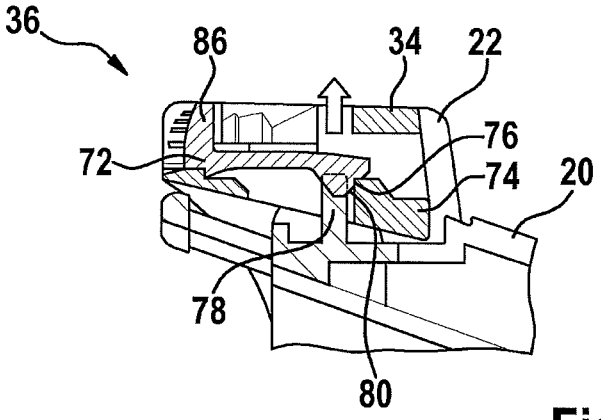
FIG. 6 shows a partial cross-section through the plug lever of the plug-in system of FIG. 1.

Plug lever 22 has a cross-beam 34 that connects the two arms 24 and in which a plug securing device 36 is mounted (see FIG. 6).

Each plug 12*a*, 12*b* and the associated plug module 14*a*, 14*b* has a miniaturized contact spacing of 1.8 mm, and is realized in six rows. The pins in plug module 12*a*, 12*b* have a cross-section of 0.5 mm by 0.4 mm. In this way, more contacts can be accommodated in a smaller space.

Figure 2:
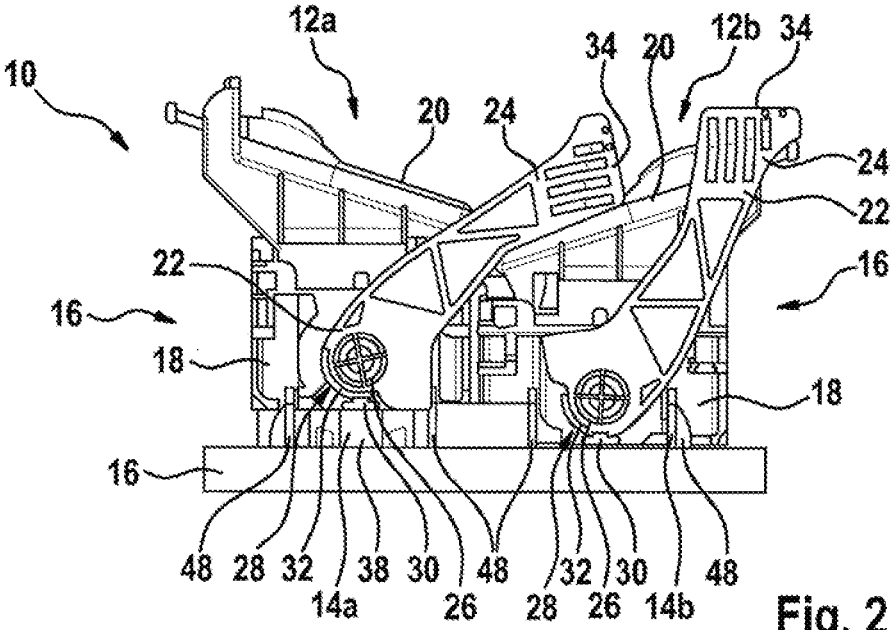
FIG. 2 shows a side view of the plug-in system of FIG. 1.

FIG. 2 shows a longitudinal section through plug-in system 10. Plug 12*a* is shown in a start position, and plug 12*b* is shown in an end position.

In the case of plug 12*a* it can be seen that plug module 14*a* (and also plug module 14*b*) has an edge/shroud 38 on which plug 12*a* is placed in the start position. Arm 24 of first plug 12*a* is placed, in the start position, on cover 20 of second plug 12*b*.

Figure 3:
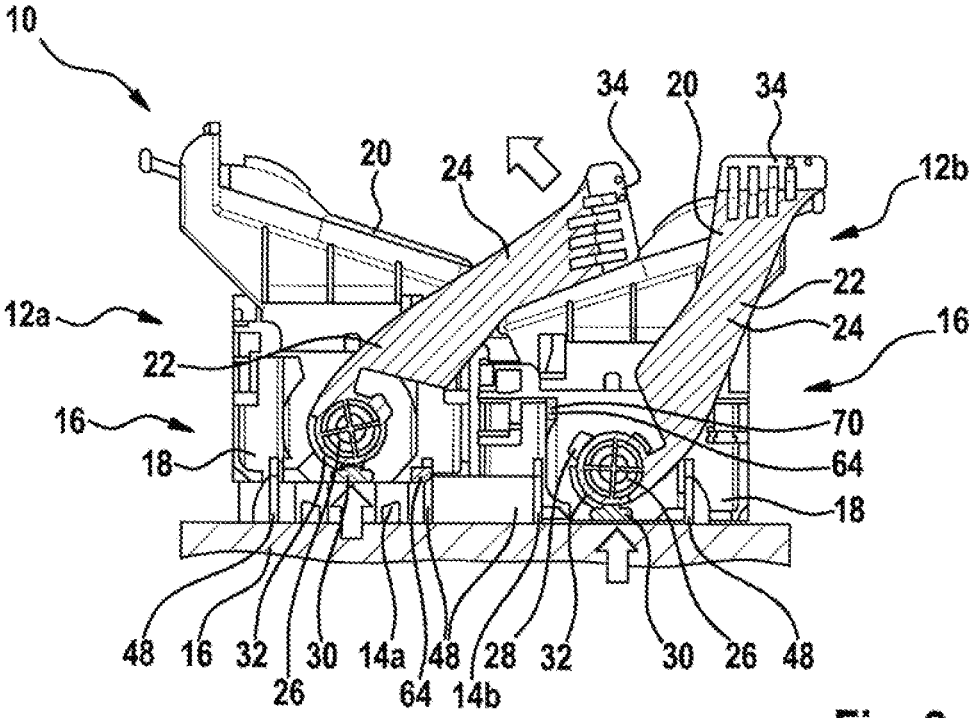
FIG. 3 shows a longitudinal section through the plug-in system of FIG. 1.

FIG. 3 shows plug-in system 10 in a cross-sectional view in which the two levers 22 on the one side of plug-in system 10 are cut away. FIG. 3 shows that a movement of lever 22 from the start position to the end position pulls plug module 14*a* into plug 12*a*. Shroud 38 is here situated in plug base 18.

Figure 4:
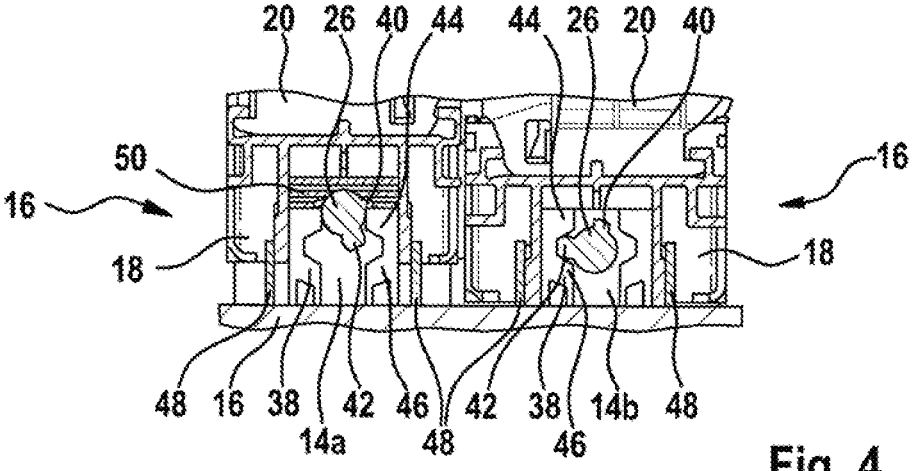
FIG. 4 shows a further longitudinal section through the plug-in system of FIG. 1.

FIG. 4 shows plug-in system 10 in a cross-sectional view in which the two shafts 26 are sectioned on the one side of plug-in system 10. On each shaft 26 there is situated a contact tooth 40 and a lever tooth 42. Both teeth 40, 42 are projections that stand out from shaft 26.

In the start position, contact tooth 40 is oriented in a direction transverse to the plug direction, and lever tooth 42 is oriented along the plug direction. On shroud 38, there is externally situated a projection 44 on which contact tooth 40 is placed in the start position. In the start position, plug base 18 already extends past shroud 38, in order to position plugs 12*a*, 12*b* in such a way that contact tooth 40 is correspondingly placed.

If lever 22 is moved into the end position, shaft 26 rotates and lever tooth 42 engages under projection 44 and pulls plug 12*a*, 12*b*, or the base 18 thereof, and plug module 14*a*, 14*b*, or shroud 38, toward one another. Contact tooth 40 here moves in such a way that it releases projection 44 and can slide past projection 44.

In the end position, contact tooth 40 is oriented in a direction opposite the plug direction, and lever tooth 42 is oriented in a direction transverse to the plug direction.

Underneath projection 44 there can be situated a further projection 46 that prevents lever tooth 42 from being moved further in the plug direction, in order to fix plug 12*a*, 12*b* in the end position.

The two projections 44, 46 can be considered as a toothed rod having to teeth 44, 46. A mirror-symmetrical configuration of teeth, or a toothed rod, can be situated on the same side of shroud 38 on plug module 14*a*, 14*b*. In this way, the same shrouds 38 can be used for the two plug modules 14*a*, 14*b*.

Teeth 44, 46, and projections 44, 46, which form between them a plug channel for shaft 26 in plug module 14*a*, 14*b*, are described in more detail below with reference to FIGS. 10 and 11.

Figure 5:
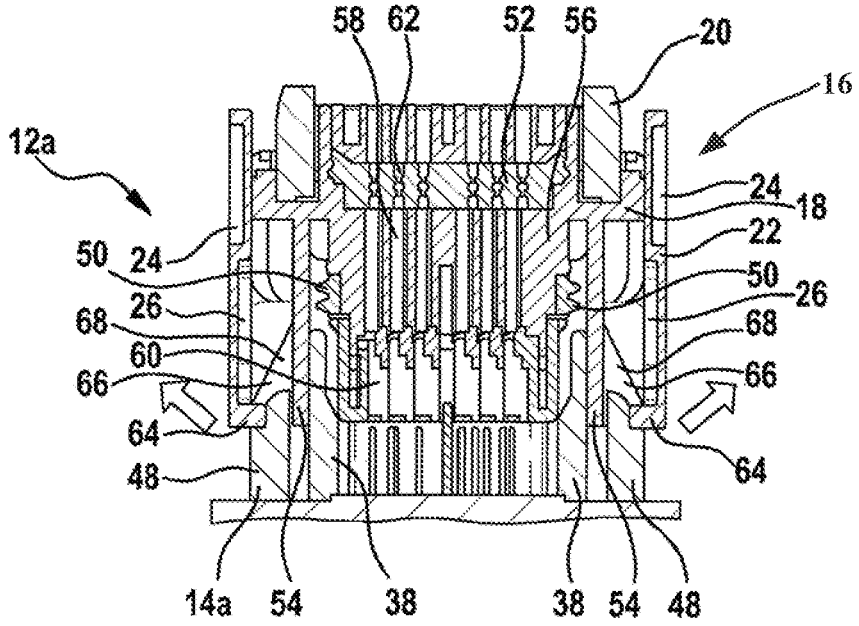
FIG. 5 shows a cross-section through the plug-in system of FIG. 1.

FIG. 5 shows a cross-section through plug 12*a* at the level of two ramps 48 of plug module 14*a*. Plug 12*a* is sealed by a radial seal 50 and a mat seal 52.

Plug base 18 has a ring or jacket element 54 that surrounds shroud 38 in the end position and that is externally flush with shroud 38. Just as shroud 38 does, jacket element 54 can have a rectangular cross-section and can be formed with an annular shape.

In addition, plug base 18 has a central or plug element 56 that is surrounded by shroud 38 in the end position. Between jacket element 54 and plug element 56 there is situated an annular recess that accommodates shroud 38.

Radial seal 50 surrounds plug element 56 at an outer wall. In order to create space for radial seal 50, shroud 38 can be tapered on the inside at an outer end.

In the plug direction, plug element 56 is shorter than jacket element 54, and is surrounded by radial seal 50, which, in the end position, is situated between the inner wall of shroud 38 and the outer wall of plug element 56.

Through plug element 56 there run guide channels 58 that accommodate lines of a cable harness. Central element 56 contains chambers 60 that accommodate contact elements, into which pins from plug module 14*a* can be pushed.

Between plug base 18 and plug cover 20 there is situated a mat seal 52 that has channels 62 through which lines can be guided and that seal the interior of plug 12*a* against the surrounding environment.

On plug lever 22, at the ends of arms 24 there is situated a securing pin 64 that points in the direction of plug body 16 (inward), and that, when plug lever 22 is in the start position and no force is acting on pin 64, lies against a housing element 66, so that plug lever 22 cannot be moved in the direction of the end position.

The edge of housing element 66 on which pin 64 lies runs essentially orthogonal to the lower edge of plug 12*a*.

Next to shroud 38 there is situated a ramp 48 on which pin 64 comes to be seated when plug 12*a* is placed onto the plug module. Through pressure on plug 12*a*, pin 64 is pressed onto ramp 48, and is pressed outward by ramp 48 away from plug body 16 in such a way that pin 64 slides over housing element 66 and releases plug lever 12*a*. This is accompanied by deformation of the region of lever 22 connected to pin 64.

During the movement from the start position to the end position of lever 22, pin 64 is guided via a ramp 68 on plug body 16 until, in the end position, it lies against a further housing or stop element 70 (see FIG. 3), which prevents a movement of lever 22 past the end position.

Plug base 18 and shroud 38 are constructed symmetrically relative to a longitudinal and to a transverse direction. Lever 22 is constructed symmetrically to the longitudinal direction. Pins 64 are situated on both sides of lever 22. Ramp 38, ramp 68, and stop elements 66, 70 are situated on both sides of plug base 18 or of the shroud, two of these components being situated on each side respectively.

FIG. 6 shows a cross section through plug 12*a* along a plane parallel to the longitudinal direction of plug-in system 10, which lies outside the plane of symmetry.

Plug securing element 36, or plug position securing element 36, includes a slide element 72 that is mounted in sliding fashion in cross-beam 34 of lever 22. However, in the unlocked position shown in FIG. 6, slide element 72 is prevented from sliding into a locked position by a locking element 74 of plug lever 22. In its front edge, slide element 72 has a groove 76 that can accommodate an edge of locking element 74.

On plug cover 20 there is situated an unlocking pin 78 that, when lever 22 presses on cover 20, presses against slide element 72 and deforms it so that the slide element is no longer seated on locking element 74 and can be pushed over it. For this purpose, slide element 72 has, following groove 76, a first ramp 80.

Cover 20 and cross-beam 34 are constructed symmetrically to a mid-plane of plug-in system 10. Thus, the slide element can have two grooves 76, and lever 22 can have two locking elements 74, and cover 20 can have two unlocking pins 78.

Figure 7:
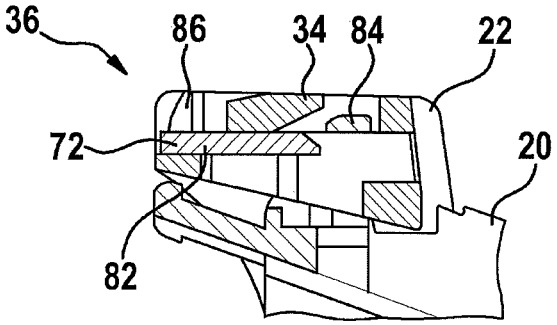
FIG. 7 shows a further partial cross-section through the plug lever of the plug-in system of FIG. 1.

FIG. 7 shows a cross-section through plug 12*a* along the plane of symmetry. Analogous to FIG. 6, slide element 72 is in the unlocked position, in which lever 22 and cover 20 are not locked to one another.

Slide element 72 has a bar 82 that is designed to be pushed into a clip 84 on cover 20, so that lever 22 can no longer be moved away from cover 20.

Figure 8:
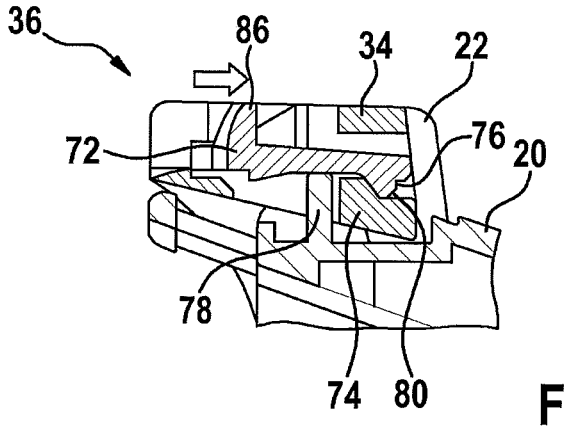
FIG. 8 shows a further partial cross-section through the plug lever of the plug-in system of FIG. 1.

FIG. 8 shows a cross-section analogous to FIG. 6, in which the slide element is in the locked position. Slide element 72 has a switch 86 with which it can be moved into the locked position. For this purpose, slide element 72 is pushed over locking element 74, where, on a further ramp in lever 22, it subsequently lies against a ramp on locking element 74. In this position, by actuating switch 86 slide element 72 can be moved back into the unlocked position, in which it bends away from locking element 74, because the two ramps slide on one another.

Figure 9:
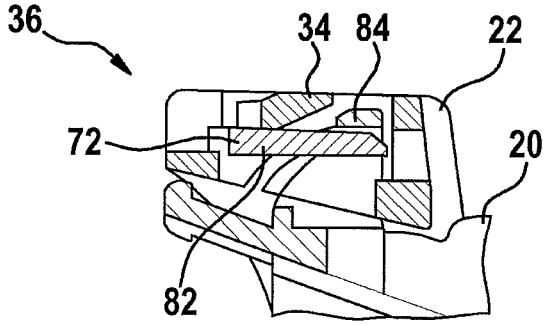
FIG. 9 shows a further partial cross-section through the plug lever of the plug-in system of FIG. 1.

FIG. 9 shows a cross-section analogous to FIG. 7. In the locked position, bar 72 is pushed into clip 84. On its front edge, bar 72 has a beveled segment that facilitates the introduction into clip 84.

Figure 10:
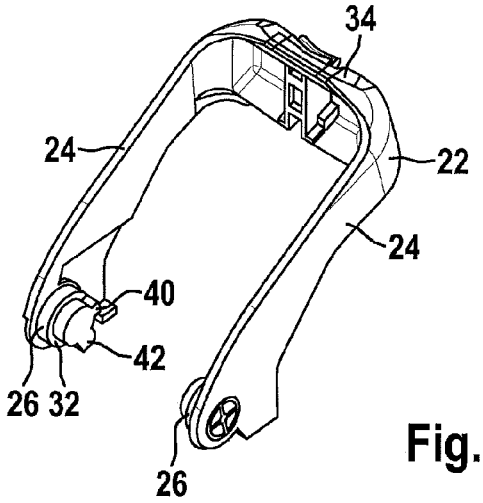
FIG. 10 shows a perspective detailed view of the plug lever of the plug-in system of FIG. 1.

FIG. 10 shows a perspective detailed view of plug lever 22 with the two U-shaped lever arms 24, which are connected to cross-beam 34. In this representation, the two shafts 26, situated on the ends of each of lever arms 24, can be seen clearly.

Each shaft 26 has a rail 32 that is accommodated in a guide groove 30 in opening 28 of plug base 18, and that fixes lever arms 28 relative to an axial direction that can be defined by the plug direction. In addition, each shaft 26 has only one lever tooth 42 and one contact tooth 40, which can stand out from shaft 26, orthogonal to a direction of longitudinal extension of shaft 26, offset by for example 90° to one another.

Opening 28 of plug base 18 can preferably be circular, and a further opening can be provided in plug base 18 that can be made complementary to lever tooth 42 and that can adjoin opening 28, so that shaft 26 can be guided through opening 28 with lever tooth 42. In addition, opening 28 can be made symmetrical relative to a midplane through opening 28, i.e., two recesses, made complementary to lever tooth 42, can be provided at opening 28, through which lever tooth 42 can be guided. In addition, two openings 28 can be configured symmetrically at two oppositely situated sides of plug body 16.

Lever tooth 42 stands out further from shaft 26 then does contact tooth 40, so that when plug lever 22 is moved from the start position to the end position, and given the associated rotation of shaft 26 by lever tooth 42, adequately large lever forces can be produced in order for example to apply the plugging forces necessary for a plugging together of plug 12*a*, 12*b* and plug module 14*a*, 14*b*.

Figure 11:
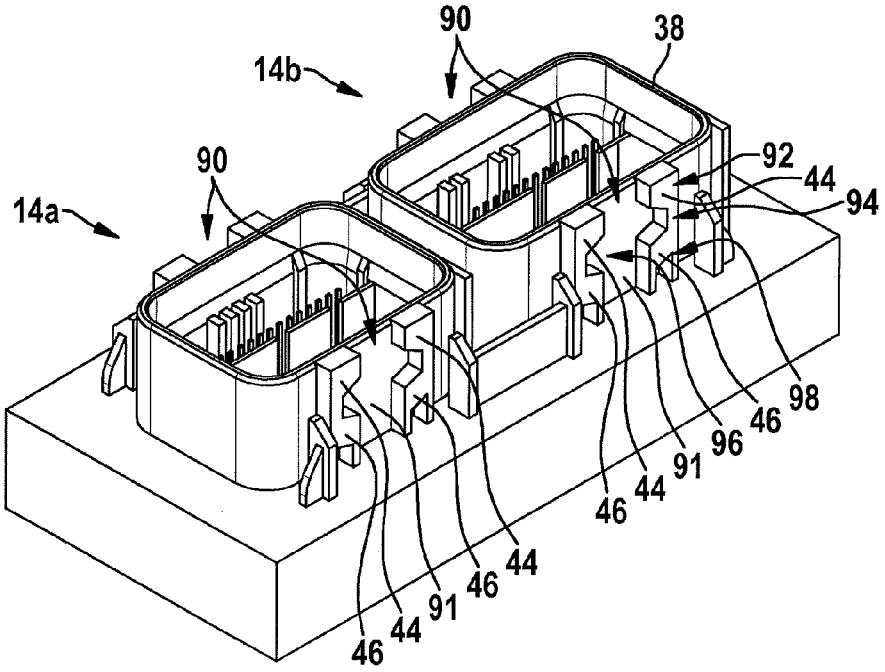
FIG. 11 shows a detailed view of the plug module of the plug-in system of FIG. 1.

FIG. 11 shows a perspective detailed view of plug module 14*a*, 14*b* of the plug-in system of FIG. 1. On two oppositely situated external sides of shroud 38, there are situated respective plug channels 90. The two plug channels 90 of a plug module 14*a*, 14*b* are constructed so as to each accommodate a shaft 26 of the two lever arms 24 of a plug lever 22.

Shroud 38 here forms a floor 91 of a plug channel 90. On a side situated opposite floor 91, i.e. a side facing away from shroud 38, plug channel 90 is open in order to accommodate shaft 26. If plug 12*a*, 12*b* is plugged onto plug module 14*a*, 14*b*, the two shafts 26 of plug lever 22 on two oppositely situated sides of plug body 16 are each accommodated in openings 28 of plug base 18, each shaft 26 being accommodated by a plug channel 90 on plug module 14*a*, 14*b*.

Each plug channel 90 has, along the plug direction, a first segment 92 that provides two symmetrical projections 44, a second segment 94 that provides two symmetrical openings 96, and a third segment 98 that provides two additional symmetrical projections 46. Here, the projections 44 of first segment 92 extend into plug channel 90 to the same distance as do projections 46 of third segment 98.

Overall, first, second, and third segment 92, 94, 98 of plug channel 90 can be fashioned as thickened parts of shroud 38, enclosing floor 91 of plug channel 90 and standing out from shroud 38. Shroud 38 and plug channel 90 can be realized in one piece or in multiple pieces. First, second, and third segment 92, 94, 98 of plug channel 90 can thus form channel walls of plug channel 90. In a multi-piece construction, the channel walls of plug channel 90 can for example be fastened to shroud 38 by a plastic spraying method, plastic welding, ultrasound welding, gluing, or riveting.

Plug channels 90 are fashioned symmetrically relative to first, second, and third segments 92, 94, 98. In other words, plug channels 90, or the channel walls, are fashioned in mirror-symmetrical fashion relative to a mid-plane through the plug channel along the direction of plugging.

The symmetrical realization of projections 44, 46 and of openings 96, or the symmetrical realization of the channel walls of a plug channel 90, makes it possible to mount plug lever 22 on plug body 16 in two orientations, lever arms 24 and plug module 14*a*, 14*b* engaging in one another, in both orientations, in such a way that plug 12*a*, 12*b* is pulled into plug module 14*a*, 14*b* by moving plug lever 22 from the start position to the end position. In other words, plug channels 90 are made symmetrical relative to the orientations of plug lever 22, so that in both orientations of plug lever 22 the plug channels can accommodate shafts 26.

As already explained in detail in relation to FIG. 4, in the start position contact tooth 40 is supported, transverse to the plug direction, on projection 44 of first segment 92 of plug channel 90, and lever tooth 42 extends along the plug direction into plug channel 90 and grasps projection 44.

When plug lever 22 is moved into the end position, shaft 26 rotates and contact tooth 40 releases projection 44 and slides past projection 44. At the same time, lever tooth 42 engages under projection 44, and pulls plug 12*a*, 12*b* into plug module 14*a*, 14*b*, or into shroud 38. Here, lever tooth 42 is pushed into recess 96 of plug channel 90. In the end position, contact tooth 40 points in a direction opposite the plug direction, and is situated in first segment 92 of plug channel 90, whereas lever tooth 42 points in a direction transverse to the plug direction, and extends into a recess 96 in second segment 94 of plug channel 90 (see also FIG. 4).

Figure 12:
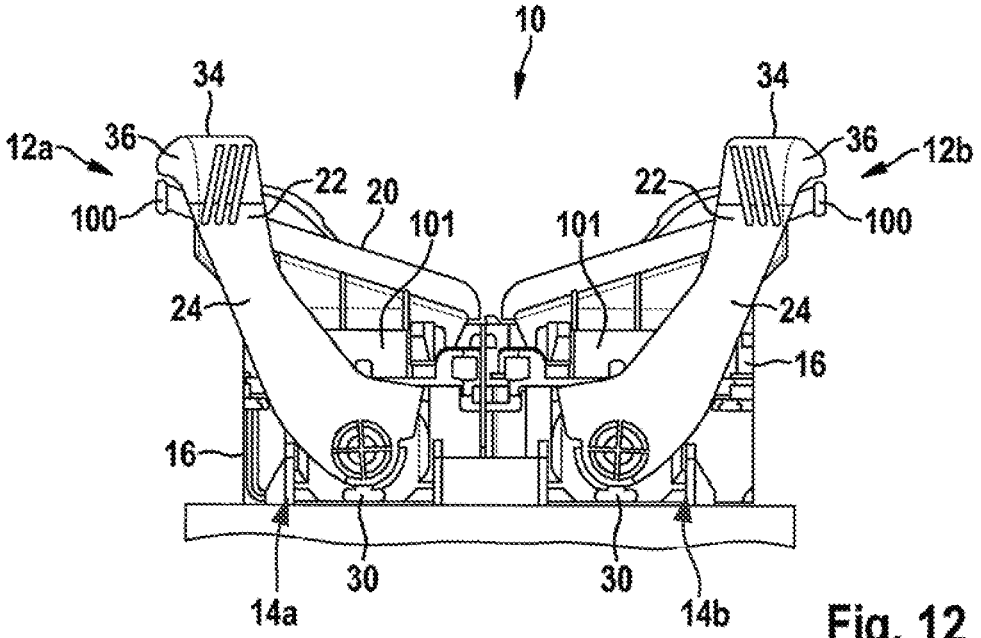
FIG. 12 shows a side view of the plug-in system of FIG. 1.

FIG. 12 shows a side view of plug-in system 10 from FIG. 1, plug lever 22 of plug 12*a*, 12*b* being shown in the end position, and being configured mirror-symmetrically relative to a mid-plane through plug-in system 10, which runs orthogonal to the plane of the drawing of FIG. 12.

Plugs 12*a*, 12*b* each have a plug cover 20. A plug cover 20 can for example have an edge 101 fashioned complementarily to an edge region of plug body 16, so that plug cover 20 can be fastened on plug body 16 for example by a positive fit and/or a force-fit.

The edge region of plug body 16, and edge 101 complementary thereto of plug cover 20, are in addition symmetrical with regard to two orientations in which plug cover 20 can be mounted on plug body 16. The orientations of plug cover 20 can for example be rotated by 180° to one another.

Plug cover 20 also has a cable conduit 100 for guiding electrical lines out from plug body 16. Corresponding to the orientation of plug cover 20, cable conduit 100 guides the electrical lines out from plug body 16 in different directions in the two orientations.

In plug-in system 10 shown in FIG. 12, plug lever 22 and plug cover 20 are mounted in anti-symmetrical orientation to one another on plug 12*a*, 12*b*. That is, plug cover 20 and plug lever 22 are configured mirror-symmetrically relative to the mid-plane through plug-in system 10, so that cable conduits 100 are oriented in opposite directions. Therefore, the electrical lines are guided out from plug 12*a*, 12*b* in opposite directions by cable conduits 100.

Figure 13:
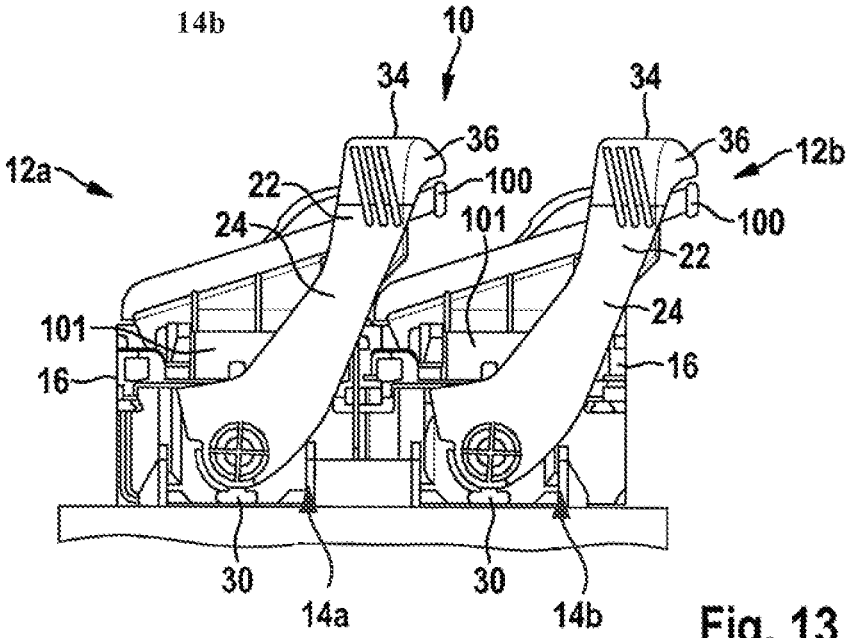
FIG. 13 shows a side view of the plug-in system according to a specific embodiment of the present invention.

FIG. 13 shows a plug-in system 10 in which plug lever 22 and plug cover 20 are each mounted on plug 12*a*, 12*b* in the same orientation to one another, so that cable conduits 100 are also oriented in the same direction. In plug-in system 10 shown in FIG. 13, the electrical lines are therefore each guided out from plug body 16 on the right side.

Figure 14:
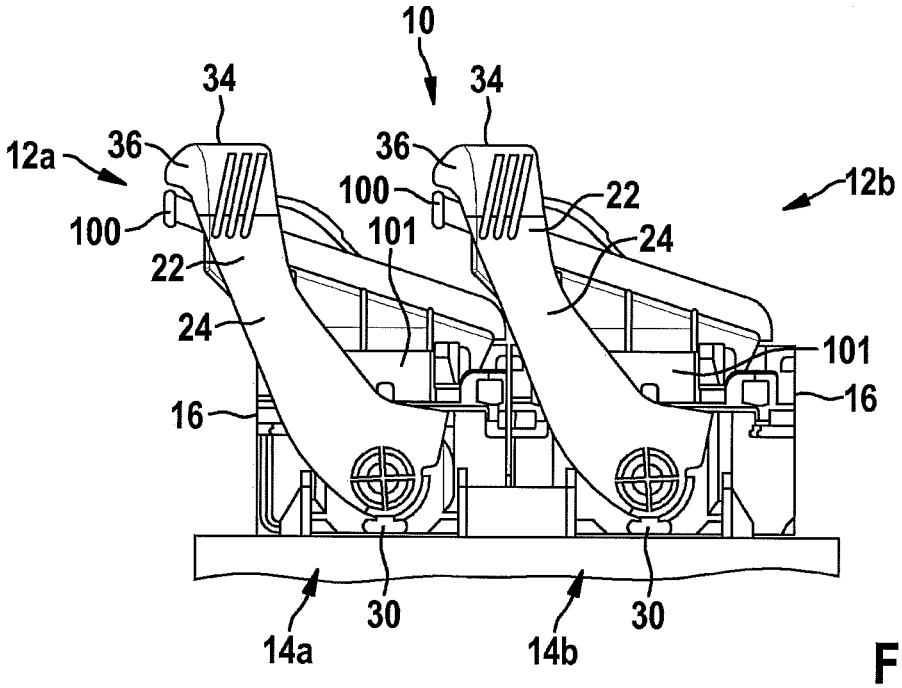
FIG. 14 shows a side view of the plug-in system according to a further specific embodiment of the present invention.

FIG. 14 shows a plug-in system 10 in which plug lever 22 and plug cover 20 are also each mounted on plug 12*a*, 12*b* with the same orientation to one another, so that cable conduits 100 also point in the same direction. In plug-in system 10 shown in FIG. 14, the electrical lines are each guided out from plug body 16 on the left side.

Overall, it is to be understood that the plug-in systems 10 shown in FIGS. 12 through 14 are made up of the same components 12*a*, 12*b*, 20, 22, which however are combined with one another with a different orientation in each case.

In addition, it is to be noted that "includes" does not exclude any other elements or steps, and "one" or "a" does not exclude a plurality. In addition, it is to be noted that features or steps that have been described with reference to one of the above exemplary embodiments can also be used in combination with other features or steps of other exemplary embodiments described above.

What is claimed is:

1. A plug-in system, comprising:

a plug; and a plug module, wherein:

the plug produces an electrical connection with the plug module, the plug includes:

a plug body in which a multiplicity of electrical contacts are accommodated, and that has a plug base that accommodates a shroud of the plug module, and a plug lever to be moved from a start position into an end position, while at the same time pulling the plug in a direction of the plug module by an action of a lever arm that engages in the plug module, the plug lever can be mounted on the plug body in two orientations, and in the two orientations, the lever arm and the plug module engage in one another in such a way that the plug can be pulled in the direction of the plug module, wherein the two orientations are turned relative to each other by approximately 180°.

2. The plug-in system as recited in claim 1, wherein:

the lever arm includes a shaft about which the plug lever can be moved in an opening in the plug body, and the shaft is oriented in a direction of the plug body.

3. The plug-in system as recited in claim 2, wherein:

the shaft includes only one lever tooth and only one contact tooth, and the lever tooth and the contact tooth are situated so as to stand out from the shaft, orthogonal to a direction of longitudinal extension of the shaft.

4. The plug-in system as recited in claim 3, wherein the lever tooth is longer than the contact tooth, so that the lever tooth stands out further from the shaft than does the contact tooth.

5. The plug-in system as recited in claim 3, wherein:

the shroud of the plug module includes a plug channel to accommodate the shaft, and the plug channel is symmetric relative to orientations of the plug lever.

6. The plug-in system as recited in claim 5, wherein:

the plug channel includes, along a direction of plugging into the plug channel, a first segment that provides two symmetrical projections, a second segment that provides two symmetrical openings, and a third segment that provides two additional symmetrical projections.

7. The plug-in system as recited in claim 6, wherein the projections of the first and of the third segments of the plug channel extend equally far into the plug channel.

8. The plug-in system as recited in claim 6, wherein:

the lever tooth of the shaft grasps one of the projections in the start position of the plug lever, and the lever tooth is capable of being pushed into one of the openings when the plug lever is moved from the start position to the end position, at the same time pulling the plug and the plug module into one another.

9. The plug-in system as recited in claim 6, wherein:

the contact tooth of the shaft is supported on the shroud on one of the projections in the start position of the plug lever, and the contact tooth is capable of releasing the projection when the plug lever is moved from the start position to the end position.

10. The plug-in system as recited in claim 1, further comprising:

a plug cover that includes a cable conduit for guiding electrical lines out from the plug body, wherein the plug cover is capable of being fastened on the plug body in the two orientations, so that in the two orientations the cable conduit guides the electrical lines out from the plug body in different directions.

* * * * *